United States Patent [19]

Rich

[11] 4,006,826

[45] Feb. 8, 1977

[54] GARMENT HANGER

[76] Inventor: Walter Rich, 1911 Spruce St., Philadelphia, Pa. 19103

[22] Filed: Apr. 2, 1975

[21] Appl. No.: 564,236

[52] U.S. Cl. ..... 211/101; 211/171

[51] Int. Cl.[2] ..... A47F 5/08

[58] Field of Search ..... 211/35, 96–102, 211/104, 168, 170–174, 175; 312/315, 326, 327, 328, 325; 248/264, 265, 268, 269, 274, 276, 284, 291, 293

[56] References Cited

UNITED STATES PATENTS

| | | | |
|---|---|---|---|
| 2,875,903 | 3/1959 | Shourds | 211/100 |
| 2,960,236 | 11/1960 | Prenveille | 211/171 X |
| 3,417,874 | 12/1968 | Bryant | 211/100 |

FOREIGN PATENTS OR APPLICATIONS

| | | | |
|---|---|---|---|
| 568,414 | 6/1958 | Belgium | 211/100 |
| 741,166 | 8/1966 | Canada | 211/96 |
| 578,527 | 7/1924 | France | 211/100 |
| 806,226 | 9/1936 | France | 211/99 |
| 701,878 | 1/1954 | United Kingdom | 211/99 |

*Primary Examiner*—Roy D. Frazier
*Assistant Examiner*—Terrell P. Lewis
*Attorney, Agent, or Firm*—Seidel, Gonda & Goldhammer

[57] ABSTRACT

The hanger device includes a hanger connected to mounting brackets by pivotable arms. A handle is pivotably connected to the hanger device for pivoting the arms to thereby lower the hanger to an access position. Spring means maintains the hanger in its lower access position and also biases the hanger to its upper storage position.

11 Claims, 6 Drawing Figures

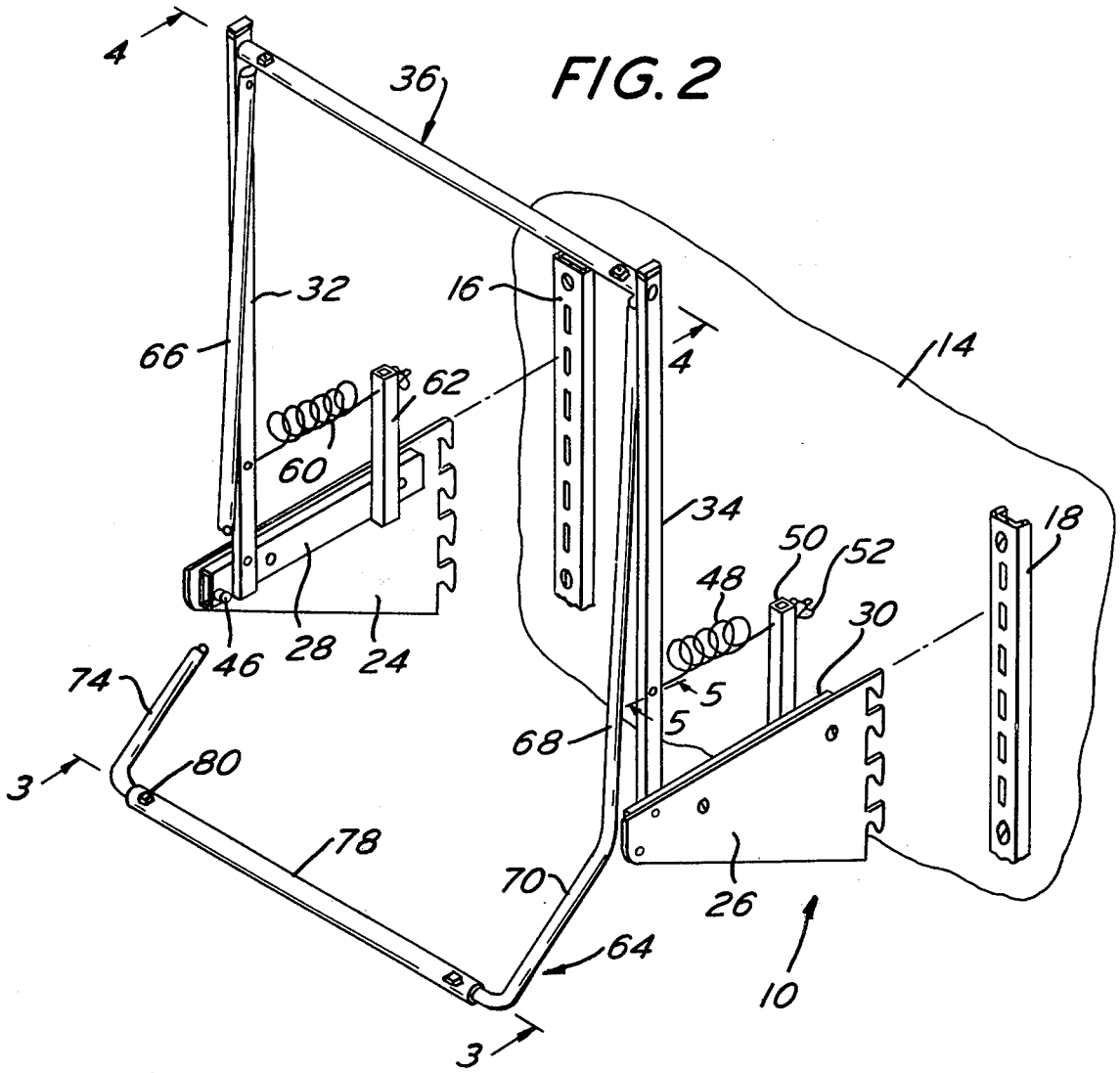
FIG. 2
FIG. 3
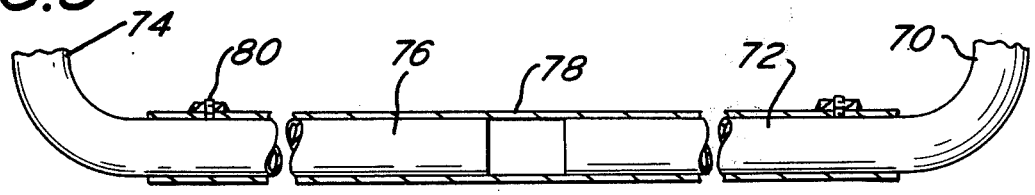
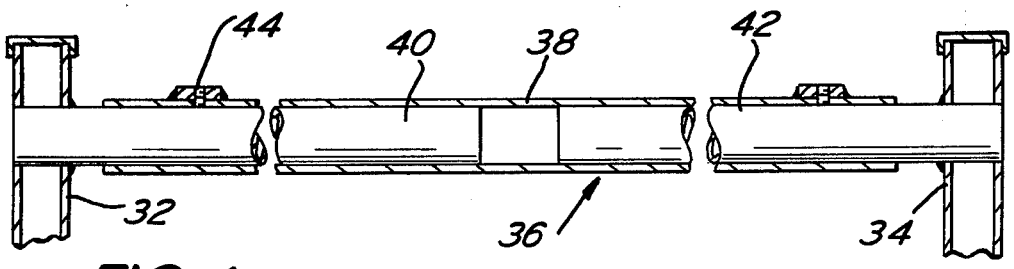
FIG. 4

GARMENT HANGER

BACKGROUND

Hangers of the general type of the present invention are known. For example, see U.S. Pat. Nos. 2,875,903 and 2,268,894. In the first mentioned patent, a garment hanger is of the type adapted to be located in a closet and thereby requires oppositely disposed side walls as well as a rear wall to support the components thereof. The second mentioned patent shows a garment hanger of the type wherein all components are on a common wall.

In prior art garment hangers such as that disclosed in U.S. Pat. No. 2,875,903, the device disclosed therein requires a separate detent in order to maintain the hanger rail in its lowermost access position. While said patent discloses springs for the garment rail, the springs are inoperative until the garment rail has moved to the position shown in FIG. 2 of that patent. Further, the springs do not bias the hanger to either the access position or the storage position. Hence, the garment rail in that patent may inadvertently pivot to an intermediate position. That disadvantage as well as others are overcome by the present invention.

This invention relates to a hanger adapted to be supported by brackets projecting from a vertical wall for enlarging the capacity of the storage area in a store or the like. The hanger includes a pair of spaced, parallel mounting brackets for supporting a hanger. A hanger device including said hanger is coupled to the brackets by a pair of arms. Each arm has an upper end connected to the hanger and a lower end pivotably connected to one of said brackets.

A handle is pivotably coupled to the hanger device between said arms for pivoting said arms to thereby lower the elevation of the hanger. A spring means is coupled to at least one of said arms for maintaining the hanger in each of its upper storage positions and lower access positions. The spring means helps to return the hanger to its storage position and is preferably adjustable.

It is an object of the present invention to provide a novel hanger for increasing the capacity of a storage area wherein a rail will have an upper storage position and a lower access position while at all times being parallel to the adjacent wall from which it is supported.

It is another object of the present invention to provide a garment hanger having an upper storage position and a lower access position which includes an over the center arrangement whereby a single spring maintains the garment rail in each of its positions.

Other objects will appear hereinafter.

For the purpose of illustrating the invention, there is shown in the drawings a form which is presently preferred; it being understood, however, that this invention is not limited to the precise arrangements and instrumentalities shown.

FIG. 2 is an exploded perspective view of the garment hanger of the present invention.

FIG. 3 is a sectional view taken along the line 3—3 in FIG. 2.

FIG. 4 is a sectional view taken along the line 4—4 in FIG. 2.

Figure 1A:
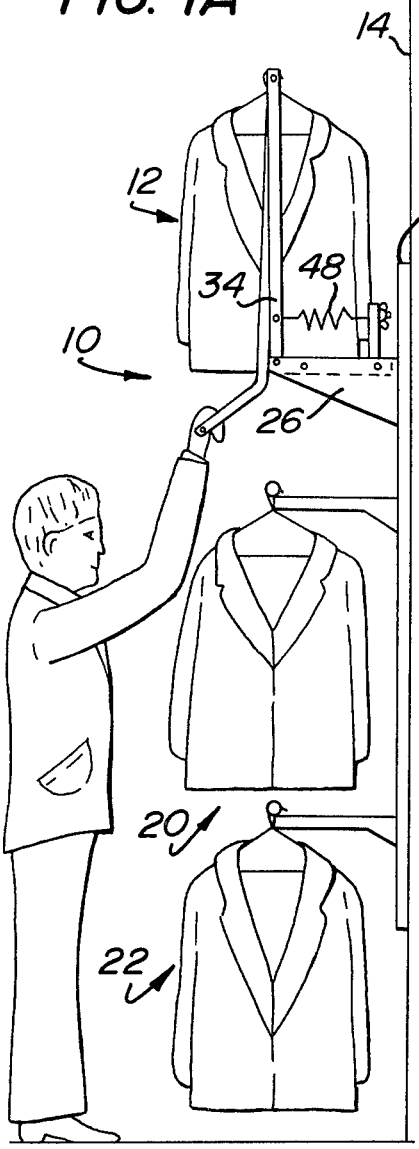
FIG. 1A is a side elevation view of the garment hanger of the present invention in its upper storage position.
Figure 1B:
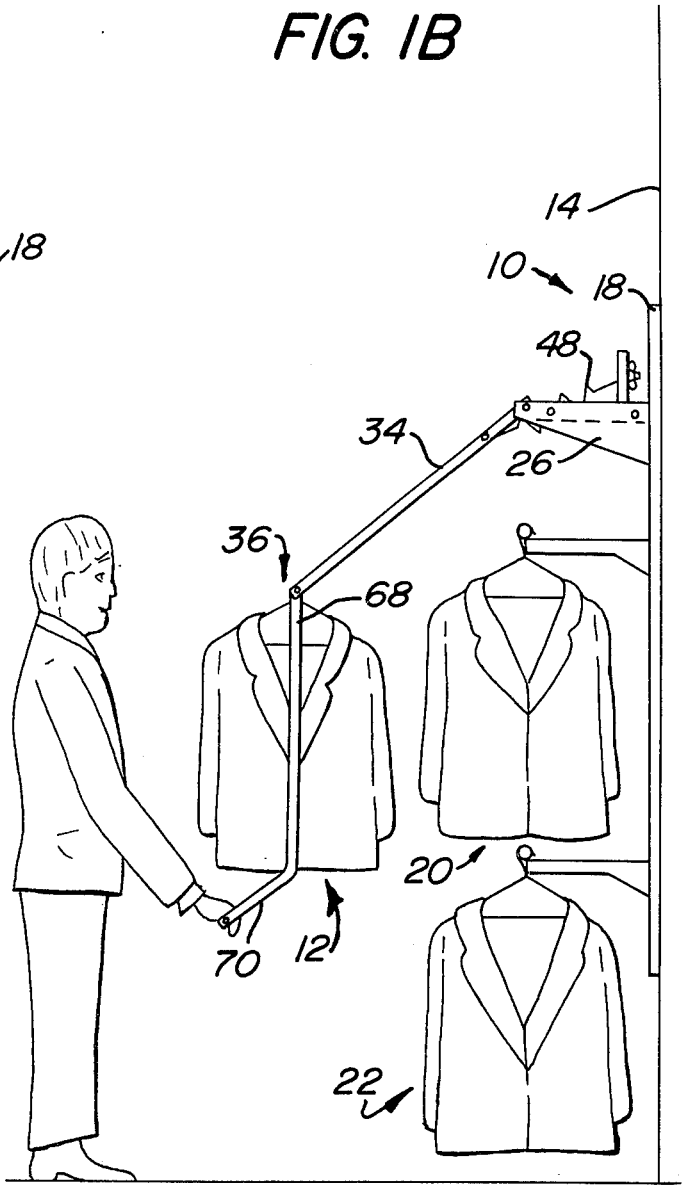
FIG. 1B is a side elevation view of the garment hanger of the present invention in its lower access position.

Referring to the drawing in detail, wherein like numerals indicate like elements, there is shown in FIGS. 1A and 1B a garment hanger in accordance with the present invention designated generally as 10. The garment hanger 10 is adapted to increase the garment storage area above that which is normally provided in a retail garment store above the racks of garments 20 and 22 supported by wall 14.

The garment hanger 10 is adapted to support a rack of garments 12 so that each garment is generally perpendicular to the wall 14. Mounting structure 16 and 18 is attached to the wall 14. Such mounting structure may be in the form of elongated strips as shown. See FIG. 2. The racks of garment 20 and 22 are also supported by the structures 16 and 18.

The garment hanger 10 includes a pair of mounting brackets 24 and 26. See FIG. 2. The brackets 24 and 26 may be generally truncated with prongs at one end adapted to be removably inserted into elongated slots in the structure 16 and 18. In this manner, the brackets 24 and 26 may be adjustably and removably coupled to the structure 16 and 18 at the desired elevation.

A support member 28 is secured to the inner face of bracket 24. A similar support member 30 is secured to the inner face of bracket 26. The lower end of a vertically disposed arm 32 as shown in FIG. 2 is pivotably connected to the support member 28. The lower end of a mating arm 34 is pivotably connected to the support member 30. In FIG. 2, the upper ends of the arms 32 and 34 are connected to a hanger rail 36.

As shown more clearly in FIG. 4, the hanger rail 36 includes a hollow cylindrical sleeve 38. A rod 40 has one end connected to the upper end of arm 32 and is telescoped into the sleeve 38. A rod 42 has one end connected to the upper end of arm 34 and its other end is telescoped into the sleeve 38. Sleeve 38 is removably secured to each of the rods 40, 42 by means of a set screw 44. That telescoping arrangement of the components of hanger rail 36 facilitates a range of adjustment for the width of the garment hanger 10.

A limit stop 46 on the support member 28 extends toward a similar limit stop on the support member 30. The limit stops contact the lower end of the arms 32 and 34 and limit the extent to which arms 32 and 34 may rotate in both a clockwise and counterclockwise direction in FIG. 2. The arms 32, 34 are adapted to pivot through an angle of about 120°–130° in a counterclockwise direction in FIG. 2.

Figure 5:
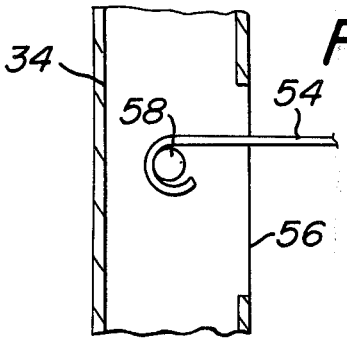
FIG. 5 is a sectional view taken along the line 5—5 in FIG. 2.

The hanger rail 36 is in its upper storage position in FIG. 2. Arm 34 is biased into contact with its limit stop on support member 30 by means of a coil spring 48. Spring 48 has one end which extends through an upright post 50 on the support member 30. The free end of the wire of spring 48 is threaded and receives a manually adjustable wing nut 52 for adjusting the tension of the spring 48. The other end of spring 48 is designated as 54 in FIG. 5 and extends through a slot 56 in the arm 34 for securement to the pin 58. Spring 48 biases the arm 34 to the upright position against its limit stop as shown in FIG. 2.

A spring 60 extends between arm 32 and post 62 on the support member 28 in the same manner as described above. Hence, arm 32 is biased by the spring 60 in a clockwise direction of FIG. 2 against the limit stop 46.

A handle designated generally as 64 is provided to pivot the hanger rail 36 from its upper storage position as shown in FIG. 1A and 2 to the lower access position shown in FIG. 1B. The handle 64 includes struts 66 and 68. Strut 66 has its upper end pivotably connected to the arm 32 adjacent the hanger rail 36. Strut 68 has its upper end connected to the arm 34 adjacent hanger rail 36. Strut 68 has an angled portion 70 and strut 66 has an angled portion 74.

Strut 68 and its angled portion 70 form an angle of about 130°. Angled portion 70 terminates in an end portion 72 which is parallel to the hanger rail 36. Angled portion 74 forms an angle of about 130° with strut 66. Portion 74 terminates in an end portion 76 which is parallel to hanger rail 36 and aligned with portion 72.

The portions 72 and 76 telescope into a hollow cylindrical sleeve 78 which is the bight portion of the U-shaped handle 64. Sleeve 78 is adjustably secured to each of the portions 72, 76 by a set screw 80. In this manner, the handle may be adjusted to various widths corresponding to the length of the hanger rail 36.

When the hanger rail 36 is in its upper storage position as shown in FIG. 1A and 2, it is biased to the position by the coil springs 48, 60. When the hanger rail 36 is in its lower access position as shown in FIG. 1B, it is biased into remaining in that position by the coil springs 48 and 60 due to the over the center arrangement wherein the longitudinal axes of the coil springs 48, 60 lie along lines which intersect or pass below the axis of rotation for the arms 32, 34. Hence, the hanger rail 36 will remain in the position shown in FIG. 1B until raised slightly by pushing up on handle 64. Thereafter, the springs 48, 60 will return the hanger rail 36 to its upper storage position as shown in FIG. 1A and 2.

The struts 66, 68 are on the inner face of the arms 32, 34 respectively to prevent any garments supported by the rail 36 from being entangled between the arms and the handle during operation. The wing nuts 52 enable the tension of the springs 48, 60 to be adjusted in relation to the weight of the goods supported by hanger rail 36. Installation of the garment hanger 10 does not in any way interfere with the access to the racks of garments 20, 22 while at the same time increasing the storage capacity of that area in a store or the like. It will be noted that the hanger rail 36 is parallel to the wall 14 at all times.

While the above description relates to a garment hanger, it should be apparent that this invention may be used for supporting other goods such as curtains, sheets, etc. Also, the present invention may be used in stores such as supermarkets or the like where there is a need to increase the storage area for display of goods. In a supermarket or the like, the hanger rail 36 may support shelves for the goods or a dispenser rack for dispensing goods by a gravity feed. Any such shelves or rack would be pivotably supported by the hanger rail 36 so as to remain upright at all times.

The present invention may be embodied in other specific forms without departing from the spirit or essential attributes thereof and, accordingly, reference should be made to the appended claims, rather than to the foregoing specification as indicating the scope of the invention.

I claim:

1. A hanger comprising structure attachable to a wall for supporting mounting brackets, a pair of mounting brackets for projecting in spaced parallel cantilever relation from said structure for supporting a hanger device, a hanger device including a hanger rail coupled to said brackets by a pair of arms, each arm having an upper end connected to said hanger rail and a lower end pivotably connected to one of said brackets, a handle pivotably connected to said hanger device between said arms for pivoting said arms about a horizontal axis to thereby lower the elevation of said hanger rail, and spring means having a first end and a second end, means for fixedly attaching said first end of said spring means to a first point which is stationary relative to said brackets, means for attaching said second end of said spring to a second point on one of said arms, the location of the second point with respect to said horizontal axis being such that an imaginary line connecting said first and said second points is disposed above said horizontal axis when said hanger rail is in its upper position and at least a portion of said imaginary line is disposed below said horizontal axis when said hanger rail is in its lower position, whereby said hanger rail is maintained in each of its upper and lower positions.

2. A hanger in accordance with claim 1 wherein said handle is U-shaped with its bight portion generally parallel to said rail, said handle including struts projecting from said bight portion, the free end portions of said struts being pivotably connected to said arms adjacent said rail, said struts being disposed between said arms.

3. A hanger in accordance with claim 2 wherein said spring means is a spiral spring.

4. A hanger in accordance with claim 1 including a limit stop on each bracket for the arm associated with each bracket, each limit stop being disposed between the free end of its associated bracket and the axis of rotation of its associated arm.

5. A hanger in accordance with claim 1 wherein said handle is generally U-shaped with a bight portion parallel to said rail, said handle including struts extending from said bight portion, each of said struts having portions connected together and forming an obtuse angle therebetween, each of said bight portion and rail being extensible along their longitudinal axis to vary the length of the rail and corresponding dimension for the handle.

6. A hanger for increasing the storage capacity of a display area comprising a pair of mounting brackets, means for securing one end of each bracket to a vertical wall so that the brackets are generally parallel to one another, a hanger device connected to said brackets, said device including a pair of arms, each arm having a lower end pivotably connected to one of said brackets for pivoting about a horizontal axis, said hanger device including a hanger connected to the upper end of said arms and disposed above the elevation of said brackets when in a storage position, said arms being pivotable from an upright position through an angle of more than 90° to position said hanger in an access position below the elevation of the axis of rotation of said arms, and a hangle connected to said device between said arms, said handle being generally U-shaped with a bight portion parallel to said axis, said handle including struts extending from said bight portion, each of said struts having an angled portion connected together and forming an obtuse angle therebetween, said angled portions extending downwardly and away from said brackets to space said bight portion away from a plane defined by said struts.

7. A hanger in accordance with claim 6 including spring means connected to at least one arm adjacent the lower end thereof to maintain said hanger in its storage and access positions and to assist in returning said hanger to its storage position.

8. A hanger in accordance with claim 7 wherein each of said bight portion and hanger are extensible to vary the length of the hanger and the corresponding dimension for the handle.

9. A hanger in accordance withh claim 7 including means for adjusting the tension of said spring means.

10. A hanger in accordance with claim 7 including a limit stop on at least one bracket adjacent the other end thereof for contact with one of said arms to define the upright position of said one arm, said axis being between said limit stop and said one end of said one bracket.

11. A hanger in accordance with claim 1 including means for adjusting the tension of said spring means.

* * * * *